United States Patent [19]

Seynaeve

[11] Patent Number: 4,608,959

[45] Date of Patent: Sep. 2, 1986

[54] ARROW REST IN COMBINATION WITH BOW

[76] Inventor: Fred A. Seynaeve, 3220 Rte. 67, Milan, Ill. 61264

[21] Appl. No.: 729,083

[22] Filed: May 1, 1985

Related U.S. Application Data

[63] Continuation of Ser. No. 508,896, Jun. 27, 1983, abandoned.

[51] Int. Cl.[4] ..... F41B 5/00

[52] U.S. Cl. ..... 124/24 R; 124/41 A

[58] Field of Search ..... 124/24 R, 35 A, 41 A, 124/88

[56] References Cited

U.S. PATENT DOCUMENTS

| | | | |
|---|---|---|---|
| 3,504,659 | 4/1970 | Babington | 124/41 A |
| 3,865,096 | 2/1975 | Troncoso, Jr. | 124/24 R |
| 3,935,854 | 2/1976 | Troncoso, Jr. | 124/24 R |
| 4,332,232 | 6/1982 | Troncoso, Jr. | 124/41 A X |

*Primary Examiner*—Richard T. Stouffer

*Attorney, Agent, or Firm*—Laff, Whitesel, Conte & Saret

[57] ABSTRACT

An arrow rest, for use with a bow, includes a mounting plate having a cantilever leaf spring attached thereto. The leaf spring terminates in a pair of vector arms set at an angle (90°) with respect to each other which receives and supports the shaft of an arrow prior to a firing of the arrow. The arrow resting in the angle on the vector arms, transfers random motions to either one or both of the vector arms when the arrow is fired from the bow, because the arrow stops these arms in a random manner. However, a plurality of bends are formed in the leaf spring to give it stiffness in some directions and flexing in other preferred directions. This flexing transfers to the bow any vector forces resulting from a flexing of the leaf spring, the transfer always being in a single preferred direction regardless of the randomness of the vector arm motions.

7 Claims, 7 Drawing Figures

ARROW REST IN COMBINATION WITH BOW

This is a continuation of U.S. patent application Ser. No. 06/508,896, filed June 27, 1983, now abandoned.

This invention relates to archery equipment, and more particularly, to a rest which may be affixed to bows.

Heretofore, bows without such a rest have allowed the arrow, when at full draw, to rest upon a region of the bow which is known as the arrow shelf. In some instances, an arrow shelf is nothing more than a ledge extending outwardly from the side of the bow. Upon release of the bow string, the arrow sometimes bent under the pressure imparted to it by the bow string and transferred a portion of that pressure to the arrow rest with some of that transferred pressure being directed in a downward vector against the arrow rest and the remainder being directed in a inward vector toward the bow. The amount of the vectors depends, at least in part, upon the amount and direction of the bending which occurs within the shaft of the arrow, which is a random variable due to the inconsistent release of the string. Thus, as the direction and amount of each of these pressure vectors varies with each shot, shots are difficult to reproduce.

The prior art has addressed the problem of distortion of shots due to variables. Specifically, see: (Troncoso) U.S. Pat. Nos. 3,865,096; 3,935,854; 4,236,497; and 4,332,232; (Tone) U.S. Pat. No. 4,133,334; (Norris) U.S. Pat. No. 4,299,195; and (Saunders) U.S. Pat. No. 3,494,347. However, none of these patents disclose anything which converts the pressure vectors (whatever they may be) into single rebound vector which always acts in relation to the bow in the same constant direction. If such a constant vector is produced, of course, the reproducibility of the arrow shots become more constant.

Accordingly, an object of this invention is to provide new and improved devices which convert all pressure vectors, regardless of their direction or magnitude, into a single, rebound vector, of constant direction. Here, an object is to provide a means for enabling an archer to make each shot a uniform shot. Another object of the invention is to provide an economical, easily manufactured device which can be readily attached to almost any bow in order to accomplish the objects and purposes of the invention.

Further objects will be apparent from the description, drawings and claims.

In keeping with an aspect of the invention, an arrow rest, for use with a bow, includes a mounting plate having a cantilever leaf spring attached thereto. The leaf spring terminates in a pair of vector arms set at an angle 90° with respect to each other which receives and supports the shaft of an arrow prior to a firing of the arrow. The arrow resting in the angle on the vector arms, transfers random motions to either one or both of the vector arms when the arrow is fired from said bow, because the arrow contacts these arms in a random manner. However, a plurality of bends are formed in the leaf spring to give it stiffness in some directions and flexlng in other preferred directions. This flexing and subsequent recoil transfers to the arrow a uniform vector force, the recoil always being in a single preferreo direction regardless of the randomness of the vector arm motions. This causes The arrow to spring away from the bow in a uniform preferred direction.

The above mentioned and other objects and features of the invention and the manner of obtaining them will become more apparent and the invention itself will be best understood by reference to the following description of the invention in conjunction with the accompanying drawings, wherein.

Figure 1:
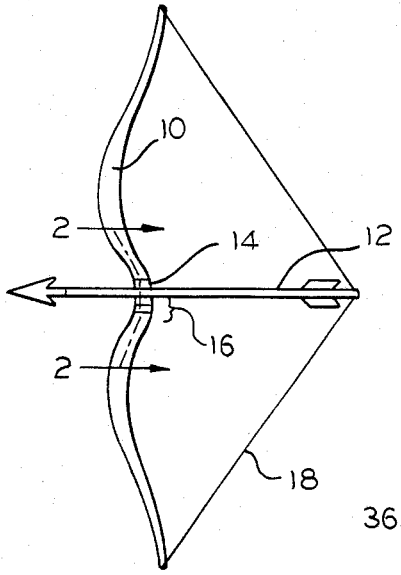
FIG. 1 is a side elevation view of one embodiment of the inventive device mounted on an examplary bow with an exemplary arrow fixed therewith.

FIG. 1 shows a bow 10, an arrow 12 and the inventive arrow rest 14. The bow 10 is intended to generically represent any conventional or non-conventional bow. The arrow 12 is any which is appropriate for the bow. Normally, an archer uses one hand to hold the bow in a grip area 16 while he draws back the arrow 12, with a bow string 18 fitted into a notch at the back of the shaft. When the bow string is released, the arrow contacts the bow and the results are an unpredictable flight of the arrow.

The arrow rest 14 (FIG. 3) is formed from a spring steel member, which is mounted on bow 10, the rest comprising a mounting plate 20 which has a mounting aperture 22 formed therein. Bending outwardly and away from the plane of mounting plate 20 is a tab 24 for receiving, supporting and providing recoil to a cantilever leaf spring arm 28. A pair of rivets 30 are used to secure the spring 28 to the tab 24 via mounting holes 32, 34. The far end of the spring 28 is composed of two vector arms 36 and 38 which are formed by cutting and shaping one piece of spring steel, bent along the lines 40, 42, 44. The bend line 40 begins some distance from the tab support and then adds stiffness in a vertical direction (i.e. parallel to the bow string) gives the leaf spring 28 a degree of stiffness in certain planes and fixed the direction in which the spring may flex. Vector arms 36, 38 are covered with a plastic (here a heat shrink tube 36*a*, 38*a*) to provide damping and to prevent noise which would not be desirable when the bow is used for hunting.

Figure 4:
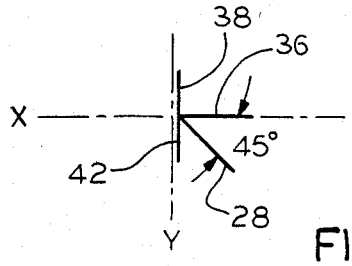
FIG. 4 is a graphical representation of the arrow guide of FIG. 3, looking in the direction of Arrow A and showing the angles of bends in a leaf spring used as an arrow guide.

FIG. 4 is a graphical showing of the end of the string looking back from the direction of travel of Arrow A. This figure shows that the tab 24 is bent by an angle of about 45° with respect to the vertical vector arm 38 with the bend line 42 forming horizontal vector arm 36 lying at a 90° angle to vertical vector arm 38. The space 40 on the leaf spring 28 is planar and it results from a bend along line 46. Space 40 is parallel to the bow 10.

Figure 3:
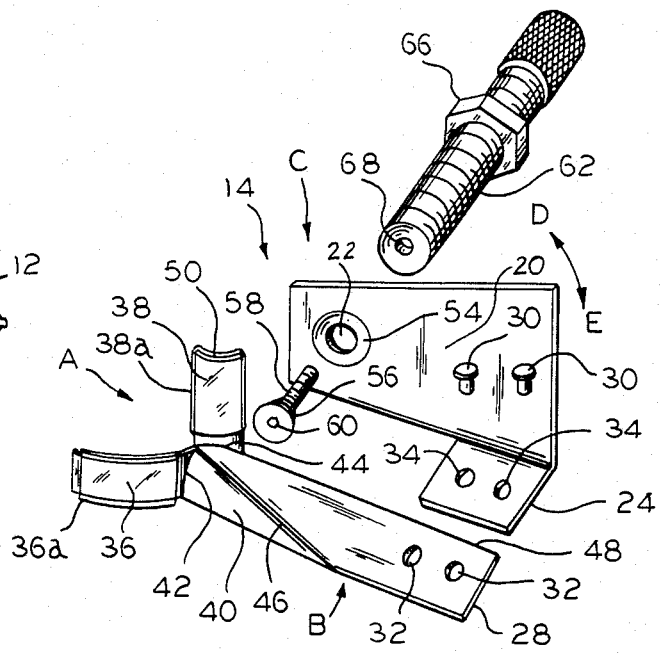
FIG. 3 is an exploded view of one embodiment of the inventive device.
Figure 5:
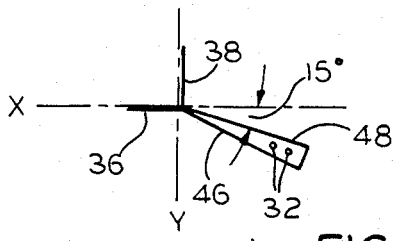
FIG. 5 is a graphical representation looking in the direction of Arrow B (FIG. 3) and showing the angles of bends in the arrow guide leaf spring.

FIG. 5 is a similar graphical presentation which shows the angles, looking at FIG. 3 in the direction of Arrow B. This figure shows that the configuration of plate 20 and its associated tab 24 causes edge 48 at the top of arm 28 to slope at an angle of about 45° with respect to the horizontal spring vector arm 36 and about 45° with respect to the bow string and the vertical vector arm 38.

Figure 6:
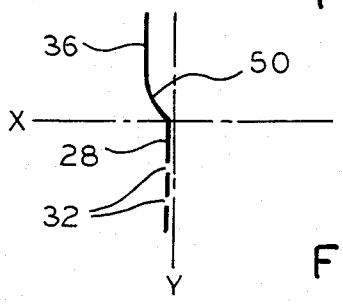
FIG. 6 is a graphical representation looking in the direction of Arrow C and showing the angles of bends in the arrow rest leaf spring.

FIG. 6 is yet another graphical presentation which shows the angle looking downwardly upon FIG. 3 in the direction of Arrow C. In this plane, the horizontal vector arm 36 is curved upward and inward in respect to top 50. It will also be noted that the horizontal arm 36 has a curvature which fits around the shaft of an arrow. This is so that the guide plate 20 (FIG. 3) may be rotated in direction E to capture the arrow against the bow or in direction D to release the arrow.

While in the preferred embodiment the angle of bend for tab 24 is about 45°, such angle may vary in a range of between 30° to 60° with respect to the vertical vector arm 38 and the bend line 42 forming the horizontal vector arm.

The plate 20 (FIG. 3) includes a mounting hole 22 having a counter sink recess 54 for receiving the head 56 of a threaded screw 58. The head 56 has an allen wrench socket 60 formed therein to enable the plate to be drawn-up tightly against the bow. A bolt 62 fits through a hole 64 in the bow 10.

The hole 64 is located generally in the region of the bow which is designed to receive the arrow while at rest and in preparation for its path towards flight.

Nut 66 may be tightened in order to securely fix bolt 62 against the bow 10. Screw 58 fits into a threaded hole 68 formed in the end of the bolt 62.

When the archer wishes to capture or release the arrow in the rest, he rotates the plate in directions D and E, about the axis formed by the screw 58.

Figure 2:
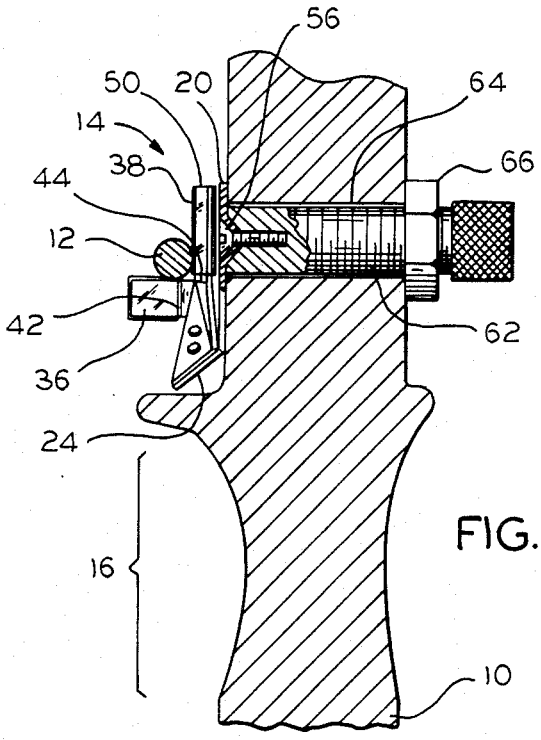
FIG. 2 is a cross section of the inventive device taken along line 2—2 of FIG. 1.

The elongated vector arms 38, 36 are set at approximately a 90° angle with respect to each other, as can be seen in FIGS. 2 and 5. These vector arms are positioned in such a way that when arrow 12 is placed between them, it is secured to preclude the possibility of the arrow slipping out of the vector arms while the arrow is being drawn. As the arrow 12 is fired, any motion of the arrow shaft slapping the bow is tranferred to either one or both of the vector arms 36, 38. The leaf spring 28 flexes to transfer any vector forces to the plate 20, and from there to the bow 10. Because of the way that the leaf spring 28 is bent, it always flexes in the same manner without regard as to how the force of the arrow bending may be distributed between the vector arms 36, 38. Therefore, the bow always receiles essentially similar forces acting in essentially the same direction regardless of any random bending of the arrow shaft.

Figure 7:
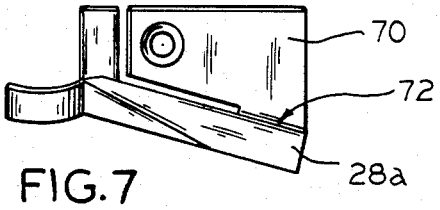
FIG. 7 is a second embodiment of the invention showing a unitary leaf spring with an integral mounting plate.

In FIG. 7, the arrow rest part is completely unitary with plate 20 (FIG. 3) being replaced by an extension 70 of the leaf spring 28a. The angle of the bend at 72 is approximately the same as the angle of the bend where the tab 24 joins the plate 20. Other than this, the embodiment of FIG. 7 is essentially the same as that of FIG. 3.

Those who are skilled in the art will readily perceive how to modify the invention. Therefore, the appended claims are to be construed to cover all equivalent structures which fall within the true scope and spirit of the invention.

The claimed invention is:

1. An arrow rest in combination with a bow and a string on said bow, said string defining a verticai direction when said bow is in use; said arrow rest comprising a mounting plate attached to said bow; a vertical vector arm and a horizontal vector arm; a cantilever leaf spring having a plurality of bends, with the cantilever leaf spring including one surface which is parallel to the bow and a further surface separated from said one surface by one of said bends; said further surface having an end attached to the mounting plate at 45° with respect to each of the bow, the vertical vector arm and the horizontal vector arm, said further surface extending downwardly and away from the mounting plate; said cantilever leaf spring terminating in the vertical and horizontal vector arms; the orientation of the vector arms being set at 90° with respect to each other, with one of said vector arms parallel to and the other of said arms perpendicular to the bow string; said vector arms being positioned so that when an arrow is placed between them and fired from such position, random motions resulting from said firing are transferred to at least one of the vector arms as the arrow is being fired and the plurality of bends formed in the cantilever leaf spring give flexing in some directions and stiffness in other directions, these bends causing the leaf spring to receive the force from the random motion of the vector arms to transfer to said arrow a recoil force, because of the uniformity of recoil, said transfer always being in a single preferred direction regardless of the randomness of said vector arm motions.

2. The combination of claim 1 wherein said mounting plate is a rigid plate having a tab thereon and said leaf spring is attached to said tab.

3. The combination of claim 2 wherein said tab is set at an angle which may vary between 30° and 60° with respect to said mounting plate.

4. The combination of claim 3 and bolt means passing through said bow for attaching said mounting plate thereto.

5. The combination of claim 4 wherein at least one of said vector arms is shaped to capture or release an arrow shaft responsive to a rotation of said mounting plate about the axis of said bolt.

6. The combination of claim 1 and means for covering each of said vector arms with plastic.

7. The combination of claim 1 wherein said mounting plate, said cantilever leaf spring, and said pair of vector arms are a single, unitary, spring member.

* * * * *